US006547350B2

(12) United States Patent
Maritan et al.

(10) Patent No.: US 6,547,350 B2
(45) Date of Patent: Apr. 15, 2003

(54) REFRIGERATOR SHELF

(75) Inventors: Marco Maritan, Viggiu' (IT); Lorenzo Bianchi, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 31 days.

(21) Appl. No.: 09/863,741

(22) Filed: May 23, 2001

(65) Prior Publication Data

US 2001/0050521 A1 Dec. 13, 2001

(30) Foreign Application Priority Data

May 30, 2000 (IT) ..... MI000335 U

(51) Int. Cl.[7] ..... A47F 3/04

(52) U.S. Cl. ..... 312/408; 312/297; 160/235; 160/36

(58) Field of Search ..... 312/297, 404, 312/408; 160/235, 290.1, 36

(56) References Cited

U.S. PATENT DOCUMENTS 1,723,460 A 8/1929 Beare
2,127,379 A * 8/1938 Adams ..... 160/227
2,139,779 A 12/1938 Stratton
2,585,136 A * 2/1952 Kuchler ..... 160/36
2,597,267 A * 5/1952 Shoemaker et al. ..... 312/272
3,894,571 A * 7/1975 Hinchliff ..... 160/201
4,128,120 A * 12/1978 Frey ..... 16/197
4,793,145 A 12/1988 Hwang et al.
4,795,206 A * 1/1989 Adams ..... 160/201
4,962,649 A * 10/1990 Battocletti ..... 454/188

FOREIGN PATENT DOCUMENTS

BE 511537 6/1952

* cited by examiner

*Primary Examiner*—Janet M. Wilkens
(74) *Attorney, Agent, or Firm*—Robert O. Rice; Stephen Krefman; Thomas J. Roth

(57) ABSTRACT

A refrigerator shelf having a plate surrounded by a frame. A guide is connected to the frame for slidable guiding of a closure member. The closure member is formed from an assembly of hinged-together bar elements which are able to pass between an extended position in which the closure member closes a chamber formed between the shelf and an underlying shelf, and a retracted position into the guide.

19 Claims, 1 Drawing Sheet

REFRIGERATOR SHELF

BACKGROUND OF THE INVENTION

1. Field of the Invention

This invention relates to a refrigerator shelf.

2. Description of the Related Art

In the refrigerator sector, the need for internal chambers (in which to preserve food for example at a temperature different from that in the rest of the preservation compartment, or otherwise separated from other foods) is satisfied in various ways. One example of such a chamber is represented by the so-called crisper representative of a chamber specifically dedicated to the preservation of fruit and vegetables. Another example is represented by the generally transparent containers resting on the shelves, for preserving foods to be maintained separated from others, for example for olfactory reasons (for example in the case of cheese).

There exist however situations which cannot be satisfied by the aforedescribed solutions, such as a partly consumed delicate cake, confectionery products and the like, which are usually preserved in a refrigerator by resting them on a shelf in the box in which they were sold, and hence exposed to odors, contamination due to other food, and damage due to careless insertion and extraction of other food products into and from the refrigerator.

SUMMARY OF THE INVENTION

An object of the present invention is therefore to provide a shelf which by virtue of its specific construction enables a closable chamber to be obtained inside the refrigerator.

Another object of the present invention is to provide a shelf able to form a chamber by retractable means.

DESCRIPTION OF THE INVENTION

Figure 1:
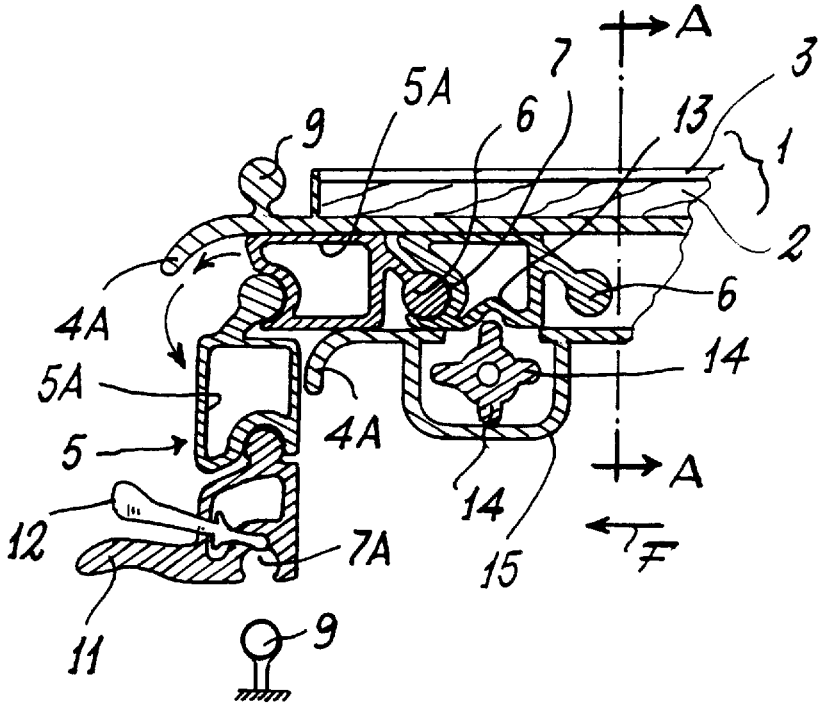
FIG. 1 is a shematic section through parts of a shelf according to the invention.
Figure 2:
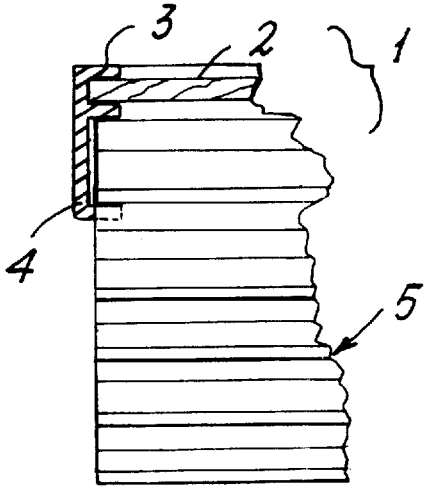
FIG. 2 is a section on the line A—A of FIG. 1.

In the figures, the reference numeral 1 indicates the shelf overall. It comprises a plate 2 of glass or of engineered polymer surrounded by a frame 3 of a different engineered Polymer. It will be appreciated by one skilled in the art that the plate 2 can be transparent, translucent or opaque as chosen by the designer.

According to the invention, the shelf is provided, along its two lateral sides, with C-shaped guide means 4 opening downwards at the front of the shelf and longitudinally towards each other. Guide means 4 may be formed in one piece with the frame 3. Guides means 4 have their front end (see FIG. 1) terminating downwards in the form of an arch (as indicated at 4A).

The guide means 4 serve to guide a closure member 5, which for convenience is identified hereinafter by the term "roll shutter". The roll shutter is formed from a plurality of substantially identical bar elements 5A hinged together by the snap-engagement of a rectilinear bulbous projection 6 in a matching groove 7 of the adjacent element. In other words each element includes a groove 7 on one side and a bulbous projection 6 on the other side.

The material of these elements can be polyvinylchloride. As with the plate 2, bar elements 5A can be formed of material that is transparent, translucent or opaque as determined by the designer.

Figure 3:
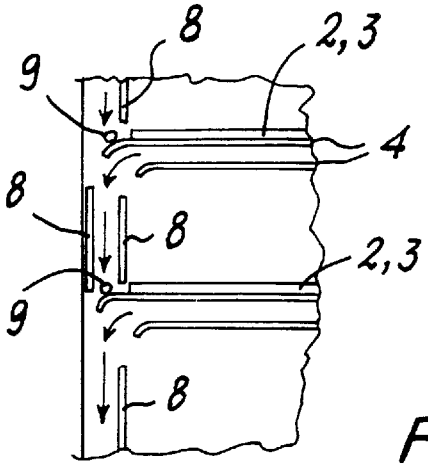
FIG. 3 is a shematic view of guide means for a retractable closure member.

As can be seen from the figures, the rectilinear bulbous projection 6 is situated at the end of a rib 6A which is inclined towards the lower side of the guide means 4 (when the element 5A is inside these latter). The matching groove 7 is also placed towards the lower side of guide means 4 to enable the roll shutter, as shown in FIG. 1, to describe with the minimum possible radius the 90° bend through which the roll shutter passes from its horizontal path defined by the guides 4 to its vertical path. When the roll shutter is in its vertical position it closes a chamber bounded on the top by the shelf which supports the roll shutter in question, in the front by the roll shutter, on the bottom by the underlying shelf and laterally by the walls of the refrigerator compartment. As shown in FIG. 3, these refrigerator walls can carry shaped vertical guide projections, indicated by 8 in said figure.

The operation of the invention should be apparent from the aforegoing description.

When the roll shutter 5 is retracted substantially entirely within the guide means 4 of its shelf 1, the aforesaid chamber is open. The roll shutter can be extended by manually moving the roll shutter frontwards (arrow F) by sliding it, it passes between the guide projections 8 to close said chamber.

As will be apparent, movement in the opposite direction causes the roll shutter to retract, i.e. to substantially withdraw below the shelf.

The figures also show that on the upper surface of part 4A of the guide means a fixed bulbous projection 9 similar to the bulbous projections 6 can be provided. A groove 7A on the leading edge of the front element 5A can be arranged to snap-engage with bulbous projection 9 in order to retain the roll shutter in position to close the chamber.

The front element of the roll shutter can differ from the others by the presence of an operating appendix or handgrip 11 and, if desired, a lever 12 to facilitate release of the bulbous projection 9 from the groove 7A with which it is engaged.

In addition, as shown in FIG. 1, the roll shutter elements 5A can be provided with longitudinal channels or depressions 13 which can be arranged to engage toothed wheels 14 supported in appendices 15 of the guide means 4 and connected to torsion springs (not shown) which are loaded when the roll shutter is lowered (chamber closed) and are released on opening the chamber, to facilitate or cause retraction of the roll shutter.

The roll shutter elements are essentially bars obtained by extrusion (hence at low cost) and can be easily adapted to refrigerator preservation compartments of different widths by cutting them to the required size. The elements are hollow and can, if desired, be filled with heat insulating material, expanded in situ. The invention is versatile in the sense that within determined limits (shelf depth), it can be used to close chambers of different by means of its roll shutter.

We claim:

1. A refrigerator shelf comprising a plate surrounded by a frame;

guide means connected to said frame for the slidable guiding of a closure member; and a closure member formed from a plurality of bar elements hinged together; said closure member being arranged to move between an extended position to close a chamber formed between said shelf and an underlying shelf, and a retracted position within the guide means.

2. The shelf as claimed in claim 1, wherein the guide means is formed integrally with said frame and extends below it.

3. The shelf as claimed in claim 1, wherein the bar elements are hollow, and include a rectilinear bulbous projection on one side and a matching groove on an opposite side which snap-engage to form a hinge connection.

4. The shelf as claimed in claim 3, wherein said rectilinear bulbous projection is disposed at the end of a rib inclined towards the lower side of the guide means, and said groove is situated close to said lower side.

5. The shelf as claimed in claim 1, wherein said guide means is provided with a bulbous projection for releasable snap-engagement with a matching groove included in a front element of another closure member.

6. The shelf as claimed in claim 5, wherein the front element includes controllable release means.

7. The shelf as claimed in claim 5, wherein the front element includes a handgrip.

8. The shelf as claimed in claims 1–7, wherein a device is provided to facilitate retraction of the closure member into the guide means.

9. The shelf as claimed in claim 8, wherein the device comprises toothed wheels mounted adjacent to said guide means and positioned to engage recesses provided in the bar elements.

10. A refrigerator shelf comprising a plate surrounded by a frame having guide means formed integrally with said frame and extending below said frame; and a closure member formed of a plurality of hollow bar elements having a rectilinear bulbous projection disposed at the end of a rib extending from said bar element and inclined towards the lower side of the guide means on one side of said bar element, and said bar element having a matching groove on an opposite side arranged for snap-engagement with a bulbous projection of another bar element to form a hinge connection of adjacent bar elements, said closure member being arranged to move between an extended position to close a chamber formed between said shelf and an underlying shelf, and a retracted position within the guide means.

11. The shelf as claimed in claim 10 further including means to facilitate retraction of the closure member into said guide means.

12. The shelf as claimed in claim 11, wherein said means to facilitate comprises toothed wheels mounted adjacent to said guide means and positioned to engage recesses provided in the bar elements.

13. A refrigerator shelf comprising a plate surrounded by a frame including guide means for slidable guiding of a closure member comprising;

a closure member formed from a plurality of bar elements hinged together and arranged to move between an extended position to close a chamber formed between said shelf and an underlying shelf and a retracted position within the guide means;

latching means including a groove in a front element of said closure member for releasable engagement with a bulbous projection on another guide means;

a controllable release means on said front element for disengaging said latching means; and a handgrip on said front element for moving said closure member between said extended and retracted position.

14. The shelf as claimed in claim 13 further including means to facilitate retraction of the closure member into said guide means.

15. The shelf as claimed in claim 14, wherein said means to facilitate comprises toothed wheels mounted adjacent to said guide means and positioned to engage recesses provided in the bar elements.

16. A refrigerator shelf comprising a plate surrounded by a frame having guide means formed integrally with said frame and extending below said frame; and a closure member formed of a plurality of hollow bar elements having a rectilinear bulbous projection disposed at the end of a rib extending from said bar element and inclined towards the lower side of the guide means on one side of said bar element, and said bar element having a matching groove on an opposite side arranged for snap-engagement with a bulbous projection of another bar element to form a hinge connection of adjacent bar elements, said closure member being arranged to move between an extended position to close a chamber formed between said shelf and an underlying shelf, and a retracted position within the guide means;

latching means including a groove in a front element of said closure member for releasable engagement with a bulbous projection on another guide means;

a controllable release means on said front element for disengaging said latching means; and a handgrip on said front element for moving said closure between said extended and retracted position.

17. The shelf as claimed in claim 16 further including means to facilitate retraction of the closure member into said guide means.

18. The shelf as claimed in claim 17, wherein said means to facilitate comprises toothed wheels mounted adjacent to said guide means and positioned to engage recesses provided in the bar elements.

19. A refrigerator shelf comprising a plate surrounded by a frame having guide means formed integrally with said frame and extending below said frame; and a closure member formed of a plurality of hollow bar elements having a rectilinear bulbous projection disposed at the end of a rib extending from said bar element and inclined towards the lower side of the guide means on one side of said bar element, and said bar element having a matching groove on an opposite side arranged for snap-engagement with a bulbous projection of another bar element to form a hinge connection of adjacent bar elements, said closure member being arranged to move between an extended position to close a chamber formed between said shelf and an underlying shelf, and a retracted position within the guide means;

latching means including a groove in a front element of said closure member for releasable engagement with a bulbous projection on another guide means;

a controllable release means on said front element for disengaging said latching means; and a handgrip on said front element for moving said closure member between said extended and retracted position; and retraction including toothed wheels mounted adjacent to said guide means and positioned to drivingly engage recesses provided on the lower surface of said bar elements for assisting movement of said closure member to said retracted position.

* * * * *